US009193419B2

(12) United States Patent
Haldeman

(10) Patent No.: US 9,193,419 B2
(45) Date of Patent: Nov. 24, 2015

(54) PADDLING TRAINING DEVICE AND BOARD

(71) Applicant: Jay Haldeman, Greensboro, NC (US)

(72) Inventor: Jay Haldeman, Greensboro, NC (US)

( * ) Notice: Subject to any disclaimer, the term of this patent is extended or adjusted under 35 U.S.C. 154(b) by 159 days.

(21) Appl. No.: 13/911,025

(22) Filed: Jun. 5, 2013

(65) Prior Publication Data

US 2014/0364280 A1 Dec. 11, 2014

(51) Int. Cl.

| | |
|---|---|
| ***A63B 21/00*** | (2006.01) |
| ***B63B 35/73*** | (2006.01) |
| ***A63B 69/06*** | (2006.01) |
| ***B63B 35/79*** | (2006.01) |

(52) U.S. Cl.

CPC ..... *B63B 35/73* (2013.01); *A63B 69/06* (2013.01); *B63B 35/795* (2013.01); *B63B 35/7933* (2013.01)

(58) Field of Classification Search

CPC ..... A63B 21/00
USPC ..... 441/66, 74, 79, 28, 27; 114/284; 482/77
See application file for complete search history.

(56) References Cited

U.S. PATENT DOCUMENTS

| | | | | |
|---|---|---|---|---|
| 4,586,451 | A | 5/1986 | Mori | |
| 5,114,370 | A * | 5/1992 | Moran | 441/65 |
| 2008/0311087 | A1 * | 12/2008 | Gosiewska et al. | 424/93.7 |
| 2009/0004936 | A1 * | 1/2009 | Mollis | 441/66 |
| 2011/0005451 | A1 * | 1/2011 | Ezra | 114/284 |
| 2014/0004762 | A1 | 1/2014 | Smith | |

FOREIGN PATENT DOCUMENTS

WO WO-2013/155433 A1 10/2013

* cited by examiner

*Primary Examiner* — Jerome W Donnelly
(74) *Attorney, Agent, or Firm* — Mintz Levin Cohn Ferris Glovsky and Popeo, P.C.

(57) ABSTRACT

A board paddling training apparatus for assisting in improving a user's paddling technique and strength. In particular, the board paddling training apparatus includes a buoyant board, such as a board adapted for surfing, bodyboarding, paddleboarding, or other board-related sport that entails paddling, and includes a resistance mechanism that creates drag or resistance against a user's paddle stroke. Some implementations of the resistance mechanism can be adjustable in order to create a variety of resistance against a user's paddle stroke and board movement.

18 Claims, 8 Drawing Sheets

PADDLING TRAINING DEVICE AND BOARD

BACKGROUND

This document is related to exercise devices, and more particularly to an exercise device for training for board paddling.

In some surface water sports performed with a board, such as surfing, bodyboarding, and paddleboarding, for example, a person propels themself along the surface of a body of water using a modified swimming motion with their arms. For example, surfing is a surface water sport in which a surfer rides on the forward face of a wave, however, the surfer must usually first perform a "paddle out" through breaking waves using the modified swimming motion to get positioned near where the waves initially break, in order to optimize their take off on the wave in which a breaking wave's power is at its maximum. The paddle out can be very rigorous and exhausting, depending on the surf conditions at the time.

Paddleboarding is a surface water sport in which participants are propelled by the modified swimming motion while lying or kneeling on a paddleboard (an elongated surfboard) or surfboard in a body of water. These types of paddleboarding techniques are known as "kneeling" or "prone" paddleboarding, respectively. A derivative of paddleboarding, which is also a hybrid of surfing, is stand up paddleboarding (SUP), in which a person standing on a larger board propels themselves by paddling with a single elongated paddle.

Board paddling, the propelling motion of most surface water sports using a board, is referred to herein as a "modified swimming motion" because the person is usually lying prone on the board, or in other cases kneeling or standing. While prone on the board, the person is higher relative to the surface of the water than in a normal swimming motion due to the buoyancy of their board, and must maintain a wider lateral placement of their arms relative to normal swimming, to account for the width of their board. Thus, while similar, the modified swimming motion used in board-based surface water sports is quite distinct and uses different muscle sets, movement and motor skills.

There have been some attempts to develop land-based training techniques for developing skills to accomplish board paddling. However, these land-based training techniques often rely on weights or machines that cannot faithfully replicate the resistance effects created by water against the modified swimming motion one experiences in real board paddling. Further, land-based training often uses machines that are expensive, difficult to maintain and calibrate, and does not provide any realistic sensation for board paddling.

Another training technique is simply to practice board paddling as much as possible. However, such technique is time consuming, and relies on a calm body of water without waves.

SUMMARY

This document presents an exercise device, and specifically an apparatus for executing and improving board paddling. The apparatus can be used in a body of water to exactly replicate realistic conditions of board paddling and the modified swimming motion.

In one aspect, a board paddling training apparatus includes a board having a top surface, a bottom surface, a nose and a tail, the board further having left and right side rails coupled between the nose and the tail, the board having a buoyancy to support a rider laying on the top surface of the board at substantially a surface of a body of water. The board paddling training apparatus further includes one or more resistance mechanisms attached to and extending down from the bottom surface of the board, the one or more resistance mechanism providing resistance against a forward movement of the board along the surface of the body of water.

In another aspect, a board paddling training kit is provided for a board having a top surface, a bottom surface, a nose and a tail, the board further having left and right side rails coupled between the nose and the tail, the board having a buoyancy to support a rider laying on the top surface of the board at substantially a surface of a body of water. The training kit includes one or more resistance mechanisms adapted to extend down from the bottom surface of the board to provide resistance against a forward movement of the board along the surface of the body of water. The kit further includes one or more attachment features for coupling the one or more resistance mechanisms to the bottom surface of the board.

The details of one or more embodiments are set forth in the accompanying drawings and the description below. Other features and advantages will be apparent from the description and drawings, and from the claims.

BRIEF DESCRIPTION OF THE DRAWINGS

These and other aspects will now be described in detail with reference to the following drawings.

Like reference symbols in the various drawings indicate like elements.

DETAILED DESCRIPTION

Figure 1:
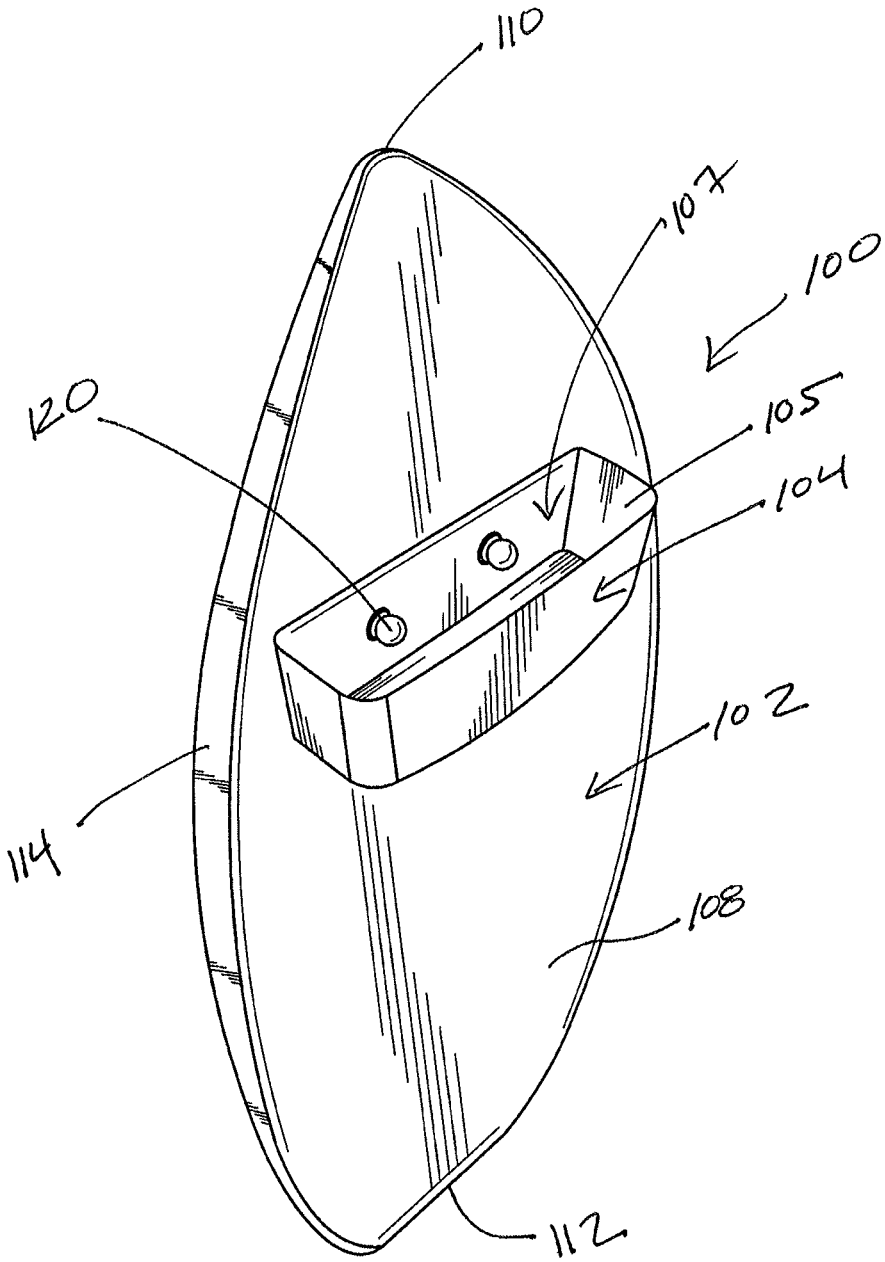
FIG. 1 shows a perspective view of an implementation of a board paddling training apparatus comprising a board and a resistance mechanism attached to a bottom surface of the board.
Figure 2:
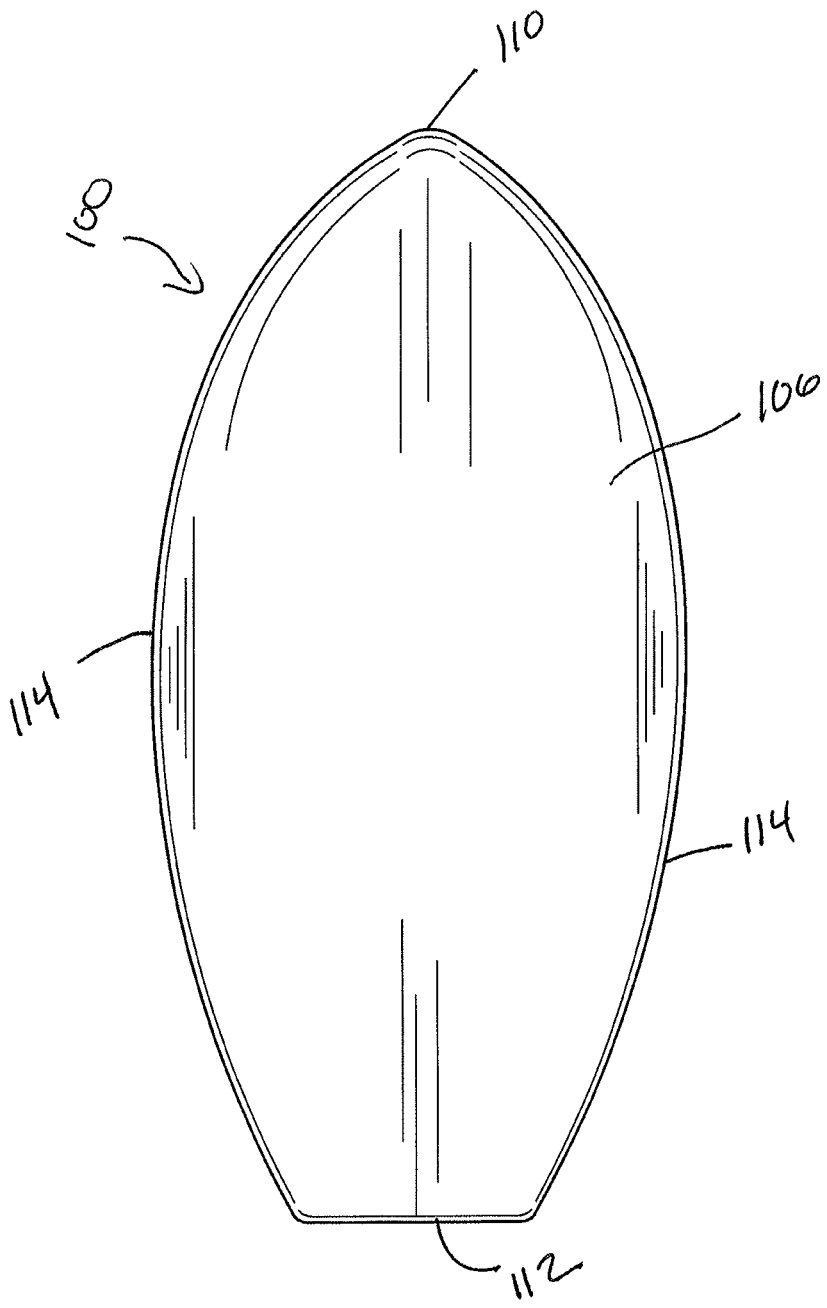
FIG. 2 shows a top view of the board paddling training apparatus of FIG. 1.
Figure 3:
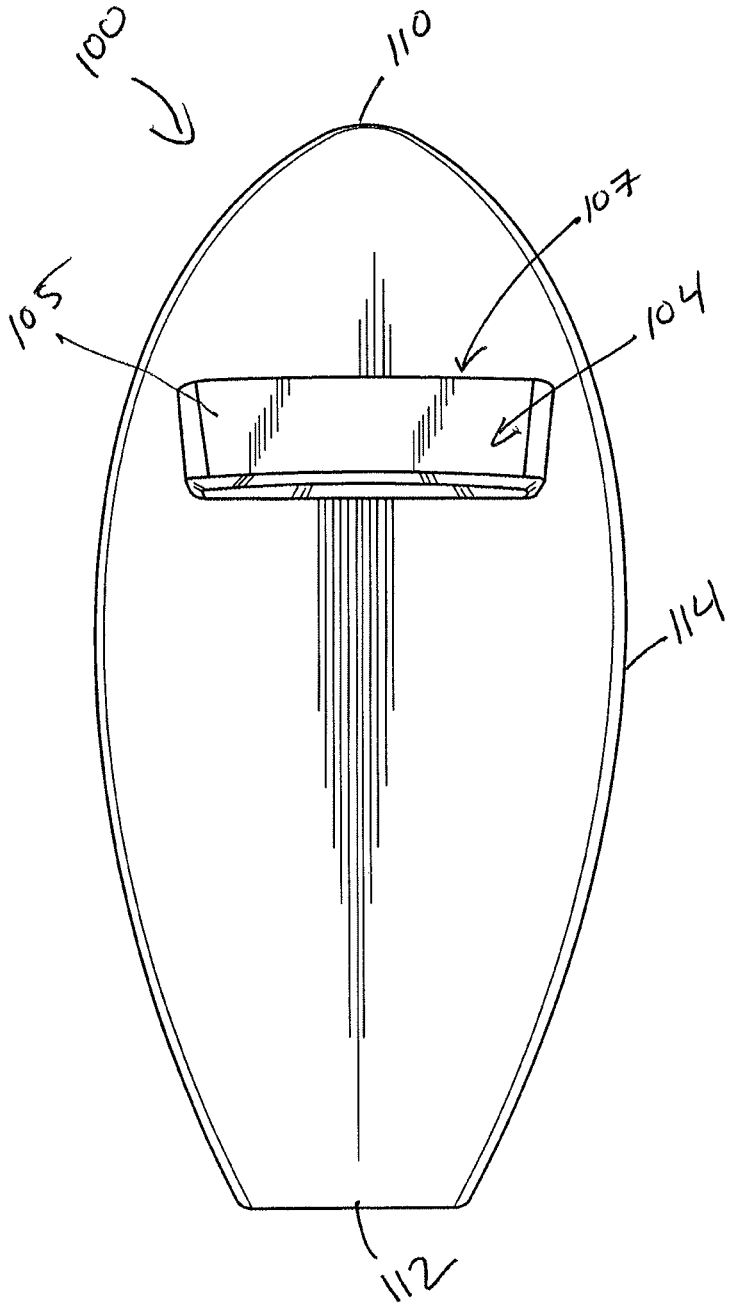
FIG. 3 shows a bottom view of the board paddling training apparatus showing an example positioning of the resistance mechanism relative to the bottom surface of the board.

This document describes an exercise or training apparatus which can assist in improving paddling technique and strength. In particular, this document describes a buoyant board, such as a board adapted for surfing, bodyboarding, paddleboarding, or other board-related sport that entails paddling, which includes a resistance mechanism that creates drag or resistance against a user's paddle stroke. As will be discussed in greater detail below, the drag or resistance created by the resistance mechanism requires a user to exert more energy and force in order to advance the board in a forward direction than what would be required to advance the board without the resistance mechanism.

In addition, the resistance mechanism allows the user to perform more paddle stokes and exert more energy over a given distance of board travel than what would be required without a resistance mechanism. This can allow a user to efficiently improve paddling technique and strength in more diverse bodies of water, including smaller bodies of water, such as a swimming pool. Furthermore, the present exercise or training apparatus provides a training mechanism which can essentially be used on a daily bases since it can be used in a controlled environment, such as a swimming pool. This can at least improve the amount of time the user can practice surfing techniques, including paddling, and strengthen muscles associated with surfing.

FIGS. 1-5 illustrate an implementation of a board paddling training apparatus 100 including a board 102 and a resistance mechanism 104. The board 102 can have a top surface 106, a bottom surface 108, a nose 110 and a tail 112. The board 102 can further have left and right side rails 114 coupled between the nose 110 and the tail 112. In addition, the board 102 can have one or more resistance mechanisms 104 attached in a variety of ways and in a variety of orientations relative to the board 102, as will be discussed in greater detail below.

The board 102 can have a predetermined buoyancy to support a rider laying on the top surface 106 of the board at substantially a surface of a body of water. For example, the buoyancy can be configured based on a volume of the board 102, including a volume or mass of buoyant material used to form the board. A type of material used to form the board 102 can also affect the buoyancy. Importantly, the board 102 is configured to support the rider on the top surface 106, while positioning most, or all, of the bottom surface 108 of the board 102 at or just under the surface of the body of water.

In some implementations, the board 102 can be made of foam, either closed cell foam or open cell foam with a seal such as glass, fiberglass, carbon fiber, or other similar materials. Additionally, the board 102 can include more than one material and the material can vary throughout the board. In some implementations, various weighted materials can be distributed to one or more areas of the board 102, such as in order to affect at least one of buoyancy or balance of the board.

The board 102 of the board paddling training apparatus 100 can be any one of a variety of boards. For example, the board 102 can be specifically configured to adapt one or more types of resistance mechanisms 104 to the board. In some implementations, the board can be a board designed for surfing, bodyboarding, paddleboarding, or other board-related sport that entails paddling of which one or more resistance mechanisms 104 can be adapted to, as will be discussed in greater detail below. Therefore, any board 102 can be used which allows any one or more of a variety of resistance mechanisms 104 to attach to the board 102 for creating increased resistance against a paddler's stoke and board movement.

Furthermore, in some implementations, the board 102 can be inflatable. Some inflatable board implementations can also include inflatable resistance mechanisms 104. In addition, inflation of the board 102 can be independent of the inflation of the resistance mechanism 104 such that the inflatable resistance mechanism 104 can be deflated while the board 102 is inflated. This can allow a user to paddle the board 102 with or without the resistance mechanism 104 creating resistance. Additionally, the amount of inflation of the resistance mechanism 104 can determine the amount of resistance the resistance mechanism 104 creates. Therefore, the user can vary the amount of resistance created by the resistance mechanism 104 (i.e., high, medium, low or no resistance) by the degree of inflation of the resistance mechanism 104.

Figure 4:
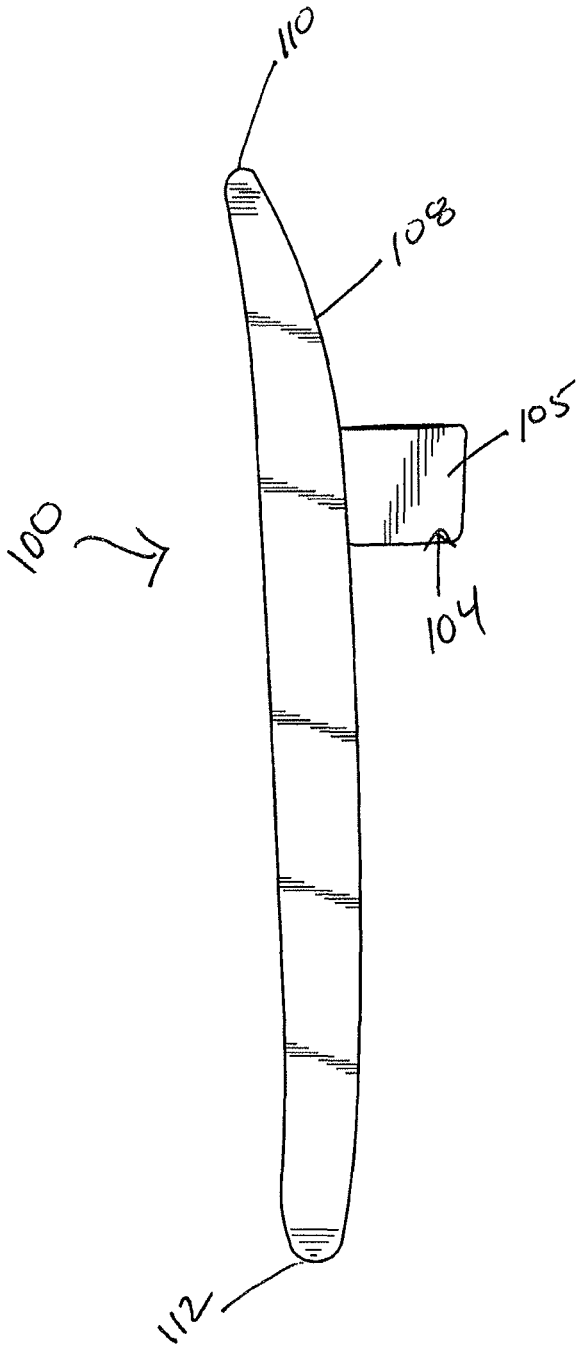
FIG. 4 shows a side view of the board paddling training apparatus showing the resistance mechanism extending a distance from the bottom surface of the board.

As shown in FIGS. 1 and 4, the resistance mechanism 104 can be coupled to the bottom surface 108 of the board 102 and extend a distance from the bottom surface 108. The resistance mechanism 104 can include a body 105 having a variety of sizes and shapes, and made out of a variety of materials. The variety of sizes, shapes and materials can create a variety of resistance against a user's paddle stoke and movement of the board 102. For example, the body 105 of the resistance mechanism 104 can be round, rectangular, or any variety of shapes that create sufficient resistance to board movement and allow a user to exactly replicate realistic conditions of board paddling and the modified swimming motion.

For example, the body 105 of the resistance mechanism 104 can be made out of a solid or rigid material and shaped in order to allow the body 105 to capture water and create resistance against a user's stroke and board movement. However, the resistance mechanism 104 can be made out of either non-rigid or non-solid material, such as one or more of a flexible, mesh, woven, fenestrated, or any similar material which can also create resistance against forward movement of the board paddling training apparatus 100. In addition, the body 105 can be made out of a variety of materials, such as both rigid and flexible materials.

Figure 5:
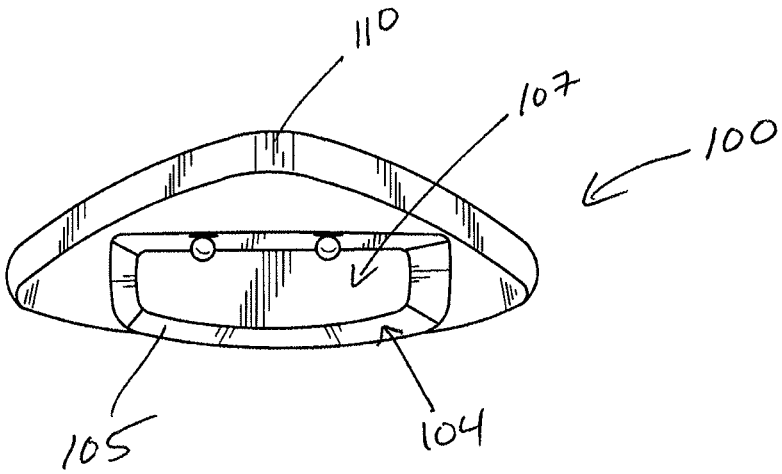
FIG. 5 shows a top view of the board paddling training apparatus showing an open side of the resistance mechanism which can capture water and create resistance to a forward movement of the board.

In some implementations, the body 105 of the resistance mechanism 104 can include an elongated bucket shape, similar to as shown in FIG. 5. The elongated bucket shape can be oriented such that an opening 107 to the body 105 is directed towards the nose 110 of the board 102. This configuration can allow water to be captured within the body 105 as the board 102 travels along a body of water in at least a forward direction (i.e., when the nose 110 of the board 102 is leading the direction of movement) which can create resistance against forward movement of the board 102.

In addition, the body 105 of the resistance mechanism 104 can be oriented in a variety of ways relative to the board 102. For example, the elongated bucket shaped body 105 can be oriented such that the opening 107 is directed towards the tail 112 of the board 102. The orientation of the resistance mechanism 104 can vary in order to create a variety of resistance against a user's paddle stroke and board movement which can be suitable for a variety of training exercises.

Furthermore, the body 105 of the resistance mechanism 104 can have any one or more features which can assist in creating a desired resistance. For example, the body 105 can include one or more cut-outs or holes which can allow fluid, such as water, to pass through. The one or more holes through the body 105 can allow some fluid to pass through the resistance mechanism 104 while other parts of the body 105 can prevent fluid from passing through which can create various turbulence effects in the water. The turbulence created by resistance mechanism 104 body features, such as holes and surface roughness, can assist in creating desirable resistance effects.

As discussed above, the body 105 of the resistance mechanism 104 can have a variety of shapes and can be configured to create a variety of resistance effects against a paddling force created by a user of the board paddling training apparatus 100. For example, the body 105 can be shaped similar to a fin. In addition, the fin shaped body 105 can be oriented in a variety of ways relative to the bottom surface 108 of the board in order to create a desired amount of resistance. For example, the fin shaped body 105 can be oriented such that it is placed perpendicular to a longitudinal axis of the board 102 in order to create a desired amount of resistance against a user's paddle stroke.

The size and shape of the body 105 of the resistance mechanism 104 can be configured such that the body 105, or any part of the resistance mechanism 104, does not interfere with the user's ability to exactly replicate realistic conditions of board paddling and the modified swimming motion. Therefore, a user can complete an arm or paddle stroke that is identical to the arm or paddle stroke the user would complete without the resistance mechanism 104 attached to the board 102. This allows the user to effectively train and strengthen muscles which can improve the user's performance on a board 102 without a resistance mechanism 104 attached.

The resistance mechanism 104 can also include a variety of features that allow for compact travel and adjustment of the resistance mechanism 104. For example, the size and shape of the body 105 of the resistance mechanism 104 can be adjusted by a user in order to adjust the resistance created by the body 105. In addition, the body 105 can be adjusted, such as formed into a compact configuration, in order to more easily transport the board paddling training apparatus 100 without having to remove the resistance mechanism 104 from the board 102. This can be a particularly useful feature for rigid-bodied resistance mechanisms 104 that extend a distance from the bottom surface 108 of the board 102.

In some implementations, the body of the resistance mechanism 104 can be adjusted by a user in order to create a desired degree of resistance (i.e., high, medium, low or no resistance). For example, a user may want to increase or decrease the amount of resistance that the resistance mechanism 104 creates in order to best accommodate the user's training needs and energy level. Therefore, some implementations can include resistance mechanism 104 adjustment features which allow a user to adjust the resistance during use, such as while the user has the board out in a body of water.

For example, a user may want to lower or increase the amount of resistance depending on various factors, such as energy level, weather conditions, water conditions, or training regimen. In addition, it can be advantageous for the user to be able to easily adjust the resistance created by the resistance mechanism 104 (i.e., without requiring the use of extraneous tools and can be accomplished by the user while out in a body of water) in order to accommodate at least one or more of the factors listed above. For example, the resistance adjustment features can cause the size, shape or orientation of the body 105 of the resistance mechanism 104 to change in order to create various degrees of resistance.

In some implementations, the resistance mechanism 104 can be adjusted or configured to create a resistance that affects one side of the user's body more than the other. For example, an implementation of the resistance mechanism 104 can create a resistance where the user's left side would have to exert more energy or force (i.e., a left-handed paddle stroke) than the user's right side in order to move the board 102 in a forward direction. This can be particularly advantageous, for example, if the user has a weaker side of which the user would like to strengthen. In particular, a person who requires rehabilitation on one side of their body from an injury can benefit from the board paddling training apparatus 100 with a resistance mechanism which requires one side of the user's body to work harder than the other.

In addition, varying the orientation of any one of the resistance mechanisms 104 relative to the bottom surface 108 of the board 102 can create various resistance effects, including creating a resistance that requires the user to exert more force on one side of the user's body over the other side. In some implementations, one or more adjustment features can allow the user to adjust the orientation of the resistance mechanisms 104 in order to create more or less of an imbalance between the amount of force required from each side of the user's body.

Figure 6:
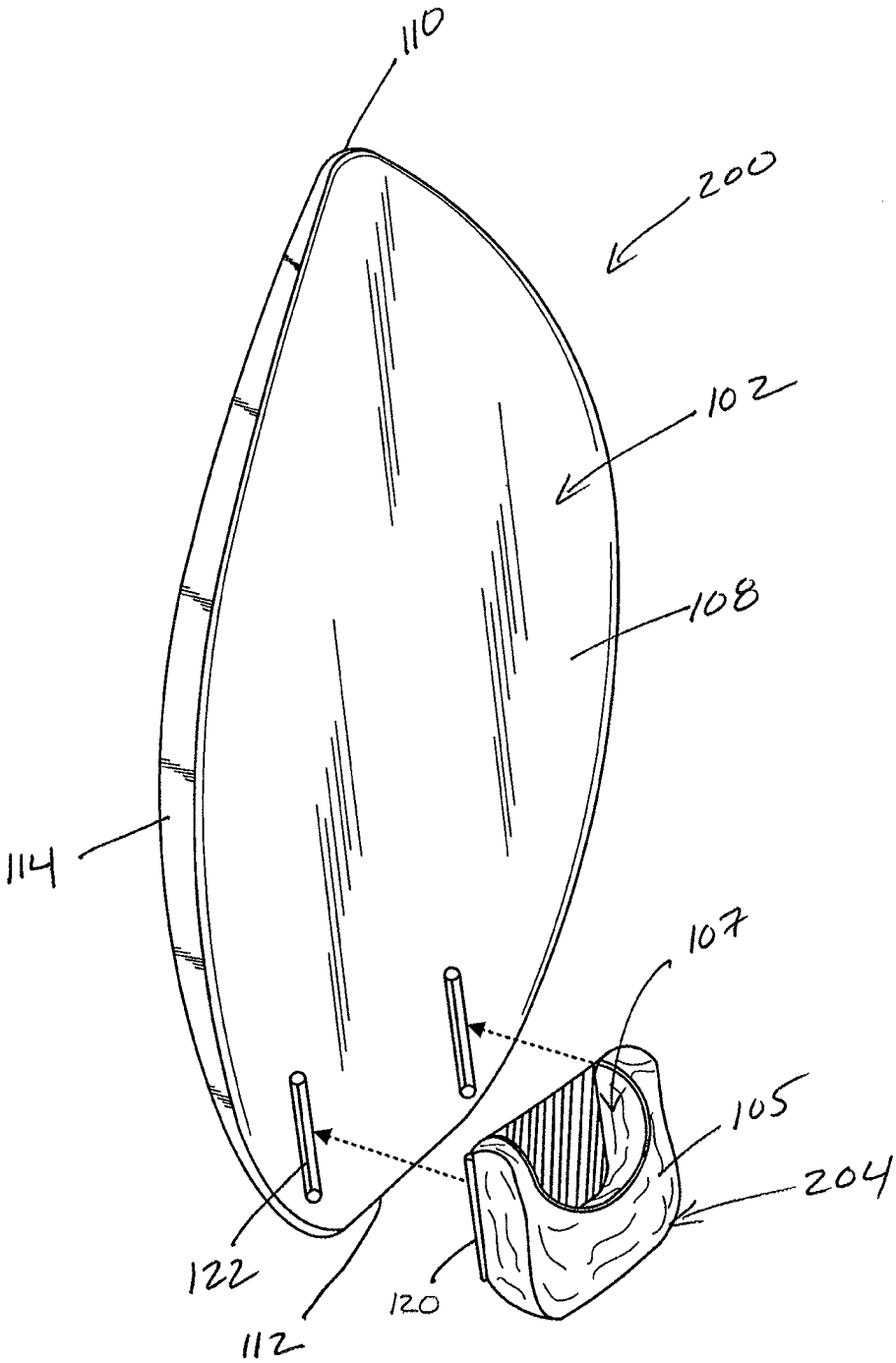
FIG. 6 shows another implementation of a board paddling training apparatus having a flexible resistance mechanism including attachment features which can attach to surf board fin boxes.

As shown in FIGS. 1 and 5, the resistance mechanism 104 can include at least one attachment feature 120 which can be configured to couple to at least one board attachment feature 122 (see FIG. 6). The attachment feature 120 and associated board attachment features 122 can allow the resistance mechanism 104 to attach to the board 102 in a variety of positions and orientations relative to the board 102. Additionally, the attachment features 120 can be configured in order to allow the resistance mechanism 104 to attach to more than one type of board 102.

For example, the attachment features 120 can be similar to a threaded engagement feature, such as a screw, which can be engaged to one or more complimentary threaded features on the board 102. However, the attachment features can include any one or more of a variety of features, including button hooks, magnets, and features adaptable to fin boxes or any of a variety of attachment features used to attach fins to surf or paddle boards. Furthermore, any one resistance mechanism 104 can be integrated with the board 102, such as contained within a glass coating, such that attachment features are not necessary.

Figure 7:
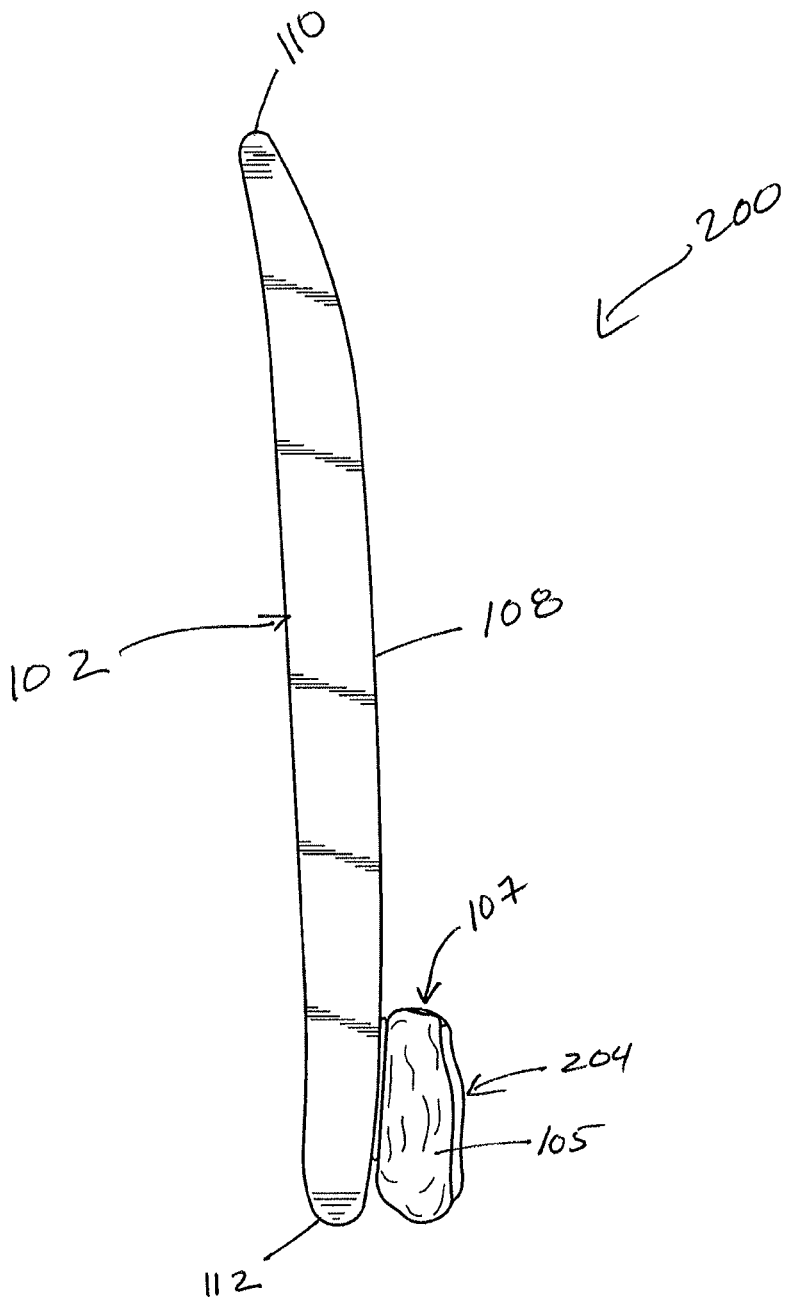
FIG. 7 shows a side view of the board paddling training apparatus of FIG. 6 showing the flexible resistance mechanism extending from a bottom surface of the board.
Figure 8:
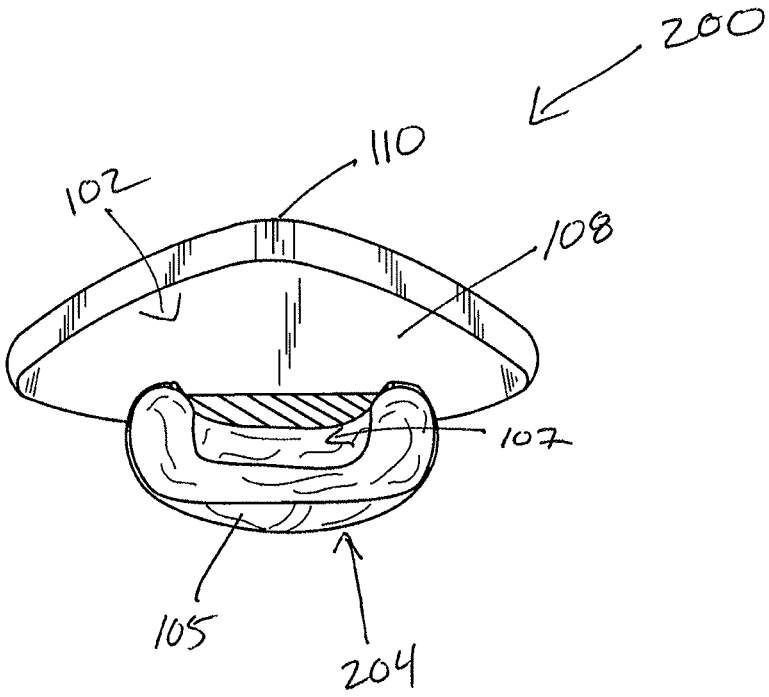
FIG. 8 shows a top view of the board paddling training apparatus of FIG. 6 showing an open side of the flexible resistance mechanism which can capture water and create resistance to a forward movement of the board.

FIGS. 6-8 illustrate another implementation of the board paddling training apparatus 200 including a board 102 and a flexible resistance mechanism 204 coupled to a bottom surface 108 of the board 102. As shown in this implementation, the flexible resistance mechanism 204 can be positioned adjacent the tail 112 of the board 102. However, the flexible resistance mechanism 204 can be positioned in any number of positions and orientations relative to the board 102. Additionally, more than one flexible resistance mechanism 204 can be attached to a surface of the board 102, such as the bottom surface 108 or along the side rail 114.

As shown in FIGS. 6-8, the body 105 of the resistance mechanism 204 can be shaped similar to a flexible bag or parachute. The flexible body 105 can create a variety of resistance effects, such as by capturing fluid through the opening 107 of the body 105 as the board 102 moves in a forward direction. In addition, the body 105 of the flexible resistance mechanism 204 can include any number of features or functions, including any of the features and functions discussed above (i.e., resistance adjustment features, holes through the body 105, etc.) in order to assist in creating a variety of resistance effects.

Furthermore, the flexible resistance mechanism 204 can include attachment features 120 which can couple directly to various paddleboard or surf board fin attachment features, such as fin boxes. As shown in the board paddling training apparatus 200 in FIG. 6, the flexible resistance mechanism 204 can be attached to a surf board such that the attachment features 120 of the resistance mechanism 204 securely couple to the same board attachment features 122 that are used to attach fins to the board, such as fin boxes. Therefore, the resistance mechanism 204 can be attached to a board 102 without the board 102 requiring any additional board attachment features 122 necessary to attach the resistance mechanism 204.

Although a few embodiments have been described in detail above, other modifications are possible. Other embodiments may be within the scope of the following claims.

The invention claimed is:

1. A board paddling training apparatus comprising:

a board having a top surface, a bottom surface, a nose and a tail, the board further having left and right side rails coupled between the nose and the tail, the board having a buoyancy to support a rider laying on the top surface of the board at substantially a surface of a body of water; and one or more resistance mechanisms attached to and extending down from the bottom surface of the board, the one or more resistance mechanism providing resistance against a forward movement of the board along the surface of the body of water, wherein the one or more resistance mechanisms are made out of at least one of a flexible, mesh, woven or fenestrated material.

2. The board paddling training apparatus of claim 1, wherein the board is made out of at least one of a closed cell foam, an open celled foam, fiberglass or carbon fiber.

3. The board paddling training apparatus of claim 1, wherein the board is designed for surfing, bodyboarding, paddleboarding, or other board-related sport that entails paddling.

4. The board paddling training apparatus of claim 1, wherein at least one of the board or the one or more resistance mechanisms are inflatable.

5. The board paddling training apparatus of claim 1, wherein the one or more resistance mechanisms comprise a hollow shape.

6. The board paddling training apparatus of claim 1, wherein the one or more resistance mechanisms are adaptable to the bottom surface of the board in a variety of orientations.

7. The board paddling training apparatus of claim 1, further comprising an adjustment feature for adjusting the resistance of the one or more resistance mechanisms.

8. The board paddling training apparatus of claim 1, wherein the one or more resistance mechanisms are configured to create an imbalance of resistance against a forward movement of the board relative to a left side and a right side of the board.

9. A board paddling training kit for a board having a top surface, a bottom surface, a nose and a tail, the board further having left and right side rails coupled between the nose and the tail, the board having a buoyancy to support a rider laying on the top surface of the board at substantially a surface of a body of water the training kit comprising:

one or more resistance mechanisms adapted to extend down from the bottom surface of the board to provide resistance against a forward movement of the board along the surface of the body of water, wherein the one or more resistance mechanisms are made out of at least one of a flexible, mesh, woven or fenestrated material; and one or more attachment features for coupling the one or more resistance mechanisms to the bottom surface of the board.

10. The board paddling training kit of claim 9, wherein the board is made out of at least one of a closed cell foam, an open celled foam, fiberglass or carbon fiber.

11. The board paddling training kit of claim 9, wherein the board is designed for surfing, bodyboarding, paddleboarding, or other board-related sport that entails paddling.

12. The board paddling training kit of claim 9, wherein at least one of the board or the one or more resistance mechanisms are inflatable.

13. The board paddling training kit of claim 9, wherein the one or more resistance mechanisms comprise a hollow shape.

14. The board paddling training kit of claim 9, wherein the one or more resistance mechanisms are adaptable to the bottom surface of the board in a variety of orientations.

15. The board paddling training kit of claim 9, further comprising an adjustment feature for adjusting the resistance of the one or more resistance mechanisms.

16. The board paddling training kit of claim 9, wherein the one or more resistance mechanisms are configured to create an imbalance of resistance against a forward movement of the board relative to a left side and a right side of the board.

17. The board paddling training kit of claim 9, wherein the attachment feature is configured to couple to a fin box of the board.

18. The board paddling training kit of claim 9, wherein the attachment feature comprises one or more button hooks, threaded features, magnets, and features adaptable to fin boxes or any of a variety of attachment features used to attach fins to a surf board or a paddleboard.

* * * * *